United States Patent [19]

Boudreau

[11] Patent Number: 4,603,635

[45] Date of Patent: Aug. 5, 1986

[54] DUAL SAFING FOR BASE ELEMENT FUZE

[75] Inventor: Jon P. Boudreau, Somerville, Mass.

[73] Assignee: Avco Corporation, Wilmington, Mass.

[21] Appl. No.: 682,686

[22] Filed: Dec. 17, 1984

[51] Int. Cl.[4] ..... F42C 15/40

[52] U.S. Cl. ..... 102/206; 102/209; 102/254; 102/256

[58] Field of Search ..... 102/206, 209, 216, 251, 102/254, 256

[56] References Cited

U.S. PATENT DOCUMENTS

| | | | |
|---|---|---|---|
| 2,647,465 | 8/1953 | Rabinow | 102/216 |
| 3,140,662 | 7/1964 | Zaugg | 102/209 |
| 4,407,201 | 10/1983 | Jensen | 102/256 |

FOREIGN PATENT DOCUMENTS

| | | | |
|---|---|---|---|
| 3223775 | 12/1983 | Fed. Rep. of Germany | 102/256 |

*Primary Examiner*—Charles T. Jordan

*Attorney, Agent, or Firm*—Abraham Ogman; Robert J. McNair

[57] ABSTRACT

A base element fuze having dual safing is disclosed. The fuze is useful with an explosive type shell propelled into a ballistic trajectory from the barrel of a gun. The fuze is actuated to move from first safety to the armed condition after experiencing the inertial setback forces of gun firing followed by the drag forces of deceleration during the ballistic flight phase before target impact. The firing circuit contains an inertial magnetic power supply or setback generator which produces a voltage pulse when the gun is fired, a storage capacitor to receive and store the pulse which is later used to initiate a detonator, and switch closure interface circuitry encircuiting the capacitor with the detonator at target impact. The sequence of events within the fuze is programmed by a spring driven rotor which is latched in first safety when assembled, is released when the gun fires, and moves to the armed position in about 18 ms. To protect against the possibility that the rotor may have become unlatched and in the armed condition at firing of the gun, a normally open relay is encircuited across the capacitor. A notch in the face of the rotor is positioned such that it will allow shell acceleration down the gun barrel to bring about closing of the relay contacts and thereby rapidly and harmlessly dissipate the charge generated by the setback generator. Secondly, a G-switch is added between one side of the capacitor and the first side of the electrical detonator element. The G-switch maintains an open circuit between the capacitor and the detonator during the time the shell is accelerating down the gun barrel. Only after the shell leaves the gun barrel and begins to slow down due to its encounter with the air, will the G-switch close to enable detonation to take place.

8 Claims, 12 Drawing Figures

Fig.5.
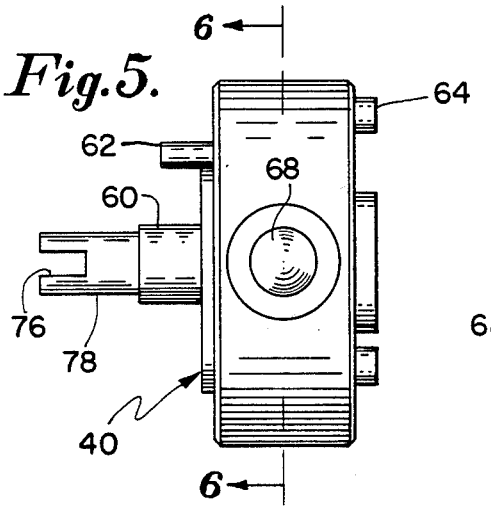
Fig.6.
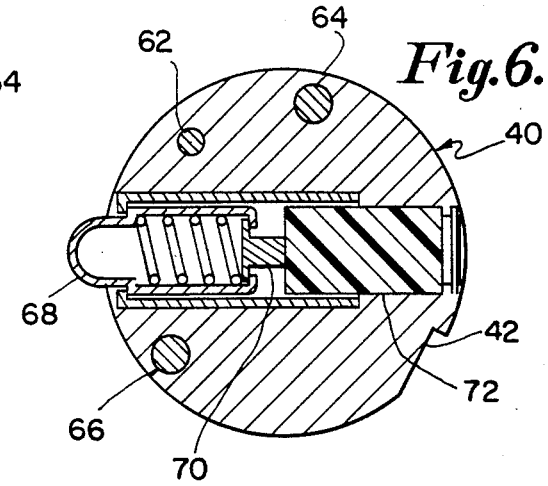
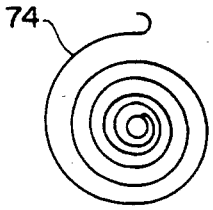
Fig.7.
Fig.8.
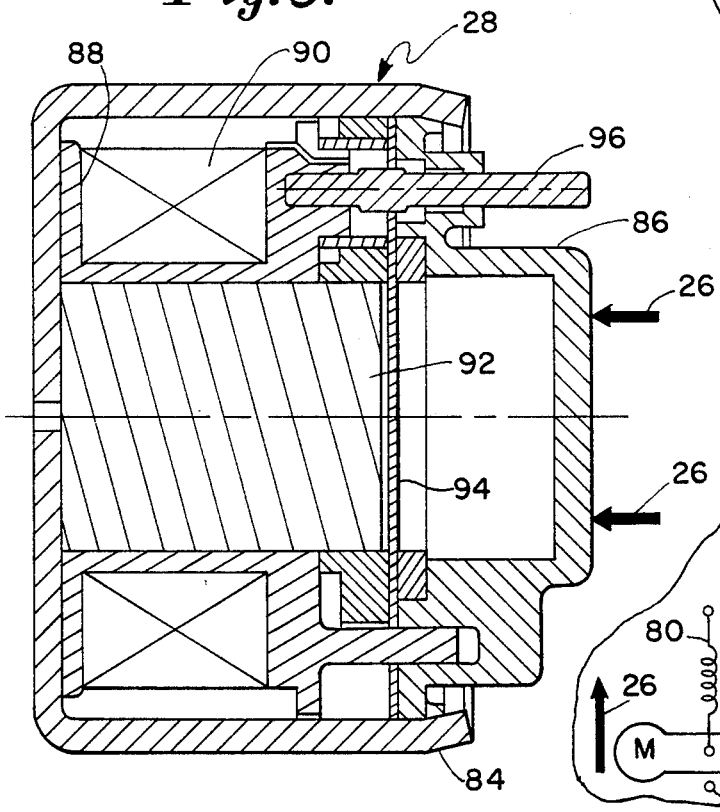
Fig.9.
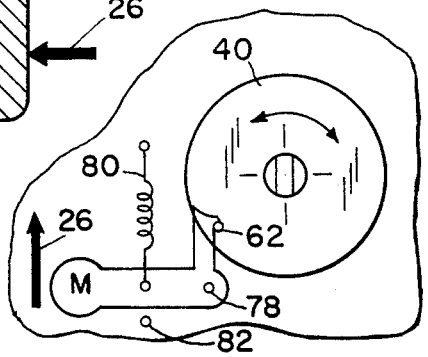

*Fig. 10.*
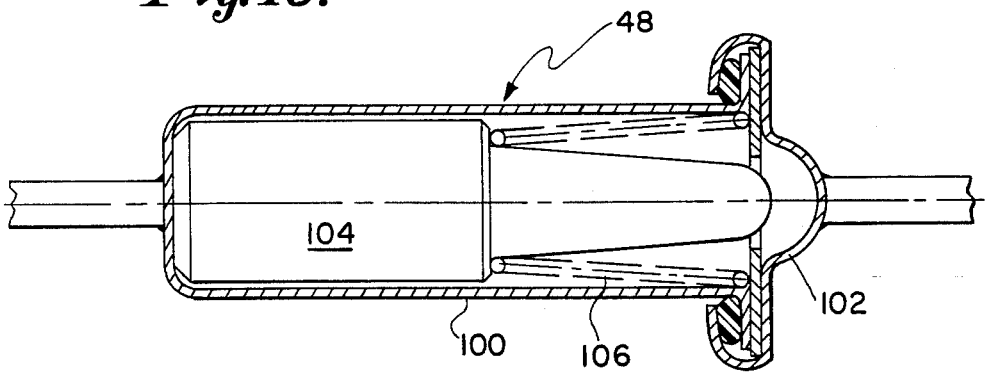
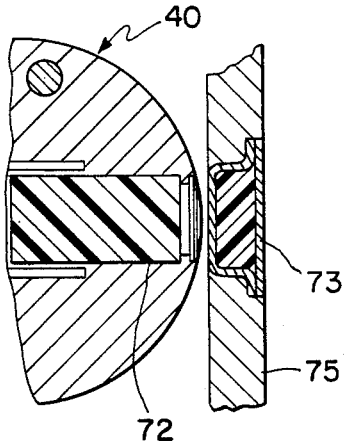
*Fig. 11.*
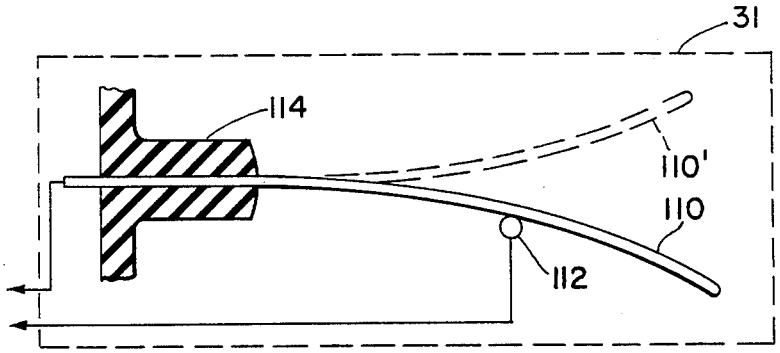
*Fig. 12.*

DUAL SAFING FOR BASE ELEMENT FUZE

BACKGROUND OF THE INVENTION

This application describes an invention made or partially made in the course of work under U.S. Government Contract DAAK10-82-C-0301.

A dual safing and arming mechanism is disclosed for use in an explosive type shell adapted to be ejected by a propulsive charge from the open end of a gun barrel.

The prior art fuze uses a single electrical safing. Incorporated within the prior art base element fuze are: (a) a setback generator which generates a pulse of electrical energy when the gun is fired and the shell begins to accelerate down the barrel; (b) a capacitor which stores the charge generated by the setback generator; (c) a spring driven rotor which is latched in first safety prior to launch, becomes unlatched on experiencing the high G forces present when the shell is accelerating down the gun barrel, rotates to the armed condition in 24 ms. after being unlatched and in the armed condition, becomes aligned to make a switch connection between one side of the capacitor and a first side of an electrical detonator element imbedded within the rotor; (d) includes circuitry to complete the connection between the second side of the capacitor and the second side of the detonator when the shell impacts a target at the end of its ballistic trajectory; and (e) a safing switch S-2 which is actuated to the "on" condition to allow the setback generator to charge the capacitor when the rotor is latched in first safety at firing of the gun, but shifts to the "off" condition if the rotor is in the armed condition at firing thus precluding shell detonation since the capacitor never receives a charge.

The prior art base element fuze has experienced reliability problems which are traceable to the functioning of safety switch S-2. My invention resolves this problem, and at the same time adds a second measure of safety in that detonation can only occur if the shell is experiencing drag due to passage through the air during flight along its ballistic trajectory path on its way to the target.

SUMMARY OF THE INVENTION

My invention is directed to an improved base element fuze. Many of the elements present in the prior art fuze are still used. However, the setback generator is hardwired so that the capacitor receives its output pulse directly without a safing switch S-2 intervening. The spring driven rotor is still used and is unlatched from first safety during acceleration of the shell down the gun barrel. After rotation of the rotor through 270 degrees, the armed condition of the fuze is reached. This takes approximately 24 ms. to be accomplished which is more than enough time for the shell to leave the gun barrel.

To protect against the possibility that the rotor may inadvertently be unlatched and in the armed condition at firing of the gun, a normally open single pole single throw relay is encircuited across the capacitor. A notch in the face of the rotor is positioned such that it will allow shell acceleration down the gun barrel to bring about closing of the relay contacts and thereby rapidly and harmlessly dissipate the charge generated by the setback generator.

Secondly, I add a G-switch between one said of the capacitor and the first side of the electrical detonator element imbedded within the rotor. The G-switch maintains an open circuit between the capacitor and the detonator during the time the shell is accelerating down the gun barrel. Only after the shell leaves the gun barrel and begins to slow down due to its encounter with the air, will the G-switch close to enable detonation to take place.

Analysis of one design shows that with my dual safing implementation, the shell will never be detonated until it is at least 70 feet away from the end of the gun barrel. Further, duds caused by unlatched rotors will be safe to work on because of the rapid dissipation of energy generated by the setback generator.

The invention, together with further objects and advantages, will be best understood by reference to the following detailed description when taken in conjunction with the accompanying drawings.

BRIEF DESCRIPTION OF THE DRAWINGS

FIG. 5 is a side view of the fuze timing rotor.

FIG. 6 is a cross-sectional view of the rotor taken along lines 6—6 of FIG. 5.

FIG. 7 is a side view of the coiled spring which rotates the rotor from the ready to the armed condition.

FIG. 8 is a cross-sectional view of the inductive setback generator.

FIG. 9 is an end view of a latching mechanism functioning to hold the rotor in first safety at shell firing.

FIG. 10 is a cutaway view of the G-switch.

FIG. 11 shows a partial cross-sectional view of the rotor in the armed condition with its detonator element aligned to set off the explosive charge-initiating squib of the shell at target contact.

FIG. 12 is a side view of the prior art safing switch.

DESCRIPTION OF THE PREFERRED EMBODIMENT

Figure 1:
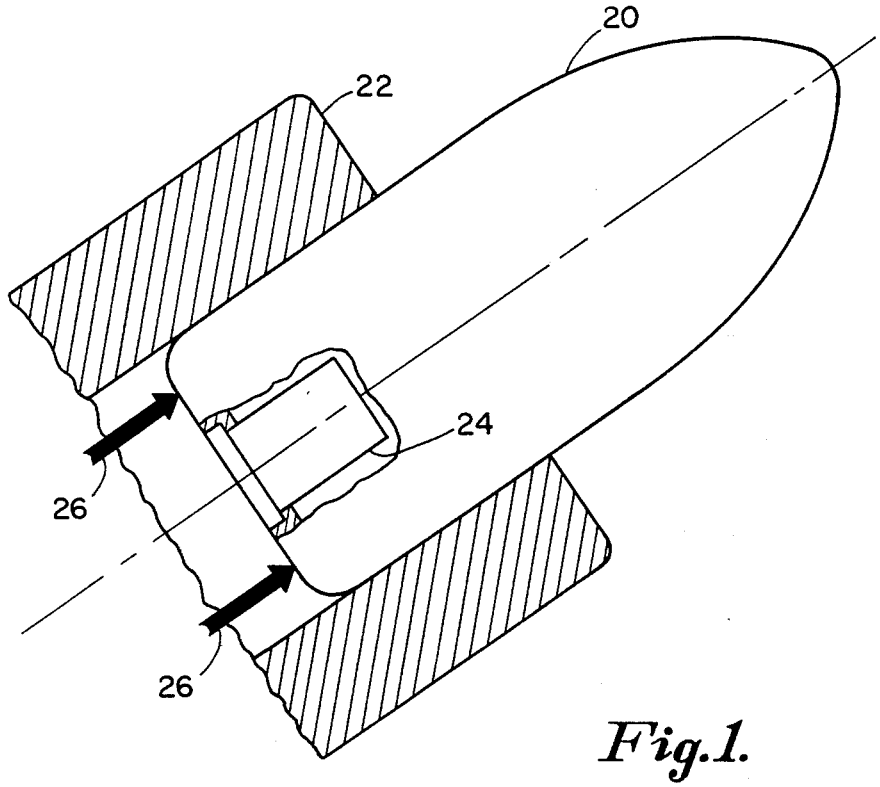
FIG. 1 is a cross-sectional view of a shell leaving the barrel of a gun and showing in cutaway fashion the location of the base element fuze.

Referring to FIG. 1, there is shown a shell 20 just emerging from the end of a gun barrel 22. In the rear portion of shell 20 is a base element fuze 24 whose purpose is twofold. First, it must detonate the shell when it strikes a target. Second, the base element fuze must incorporate safing features which preclude premature detonation of the shell either in the gun barrel or in the vicinity of the gun crew. As implemented, base element fuze 24 is generally cylindrical in shape with a diameter of about 1.25 in. and a length of about 1.75 in. The explosive charge will typically propel shell 20 out of gun barrel 22 at a velocity in excess of 3000 ft/sec. Arrows 26 represent the rapidly expanding high pressure gases which accelerate shell 20 down the gun barrel.

Figure 2:
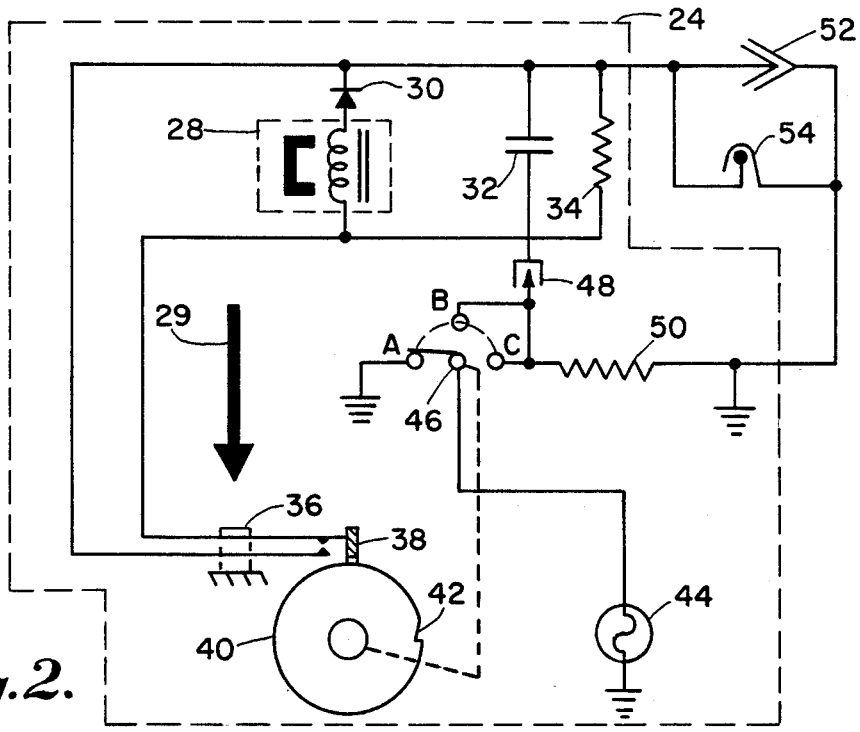
FIG. 2 is a circuit diagram of the base element fuze in first safety prior to launch.

An electrical schematic of the base element fuze containing my invention is shown in FIG. 2. The function and interrelation of the several components will be explained in detail. It is to be understood that the FIG. 2 components are packaged within the cylindrical container shown as base element fuze 24 in FIG. 1.

The circuitry of FIG. 2 includes a setback generator 28 which generates a pulse of electricity when the gun is fired, and the shell commences rapid acceleration down the barrel. The pulse of electricity passes through diode 30 and charges capacitor 32. The pulse of electricity will charge capacitor 32, providing the contacts of normally open single pole relay 36 remain in its open position. The relay contacts will remain in their open position so long as cam element 38 remains on the outer periphery of rotor 40. However, if the rotor was positioned so that notch 42 was in line with cam 38, the acceleration forces on the cam element would cause the relay contacts to close. This would not be the case for a rotor 40 which was properly latched in the first safety position wherein rotor switch 46 makes contact with the A-terminal as shown in FIG. 2.

Resistor 34 is shown encircuited across the terminals of capacitor 32. In the unit reduced to practice, capacitor 32 had a value of 0.56 μf. and resistor 34 had a value of 680 megohms. Thus the RC time constant of the combination is slightly more than 6 minutes and thereby provides safety in that an undetonated shell will become a dud.

Detonator fuze 44 is shown as being grounded on one side and encircuited with the center arm of switch 46 which rotates in synchronism with rotor 40. The B and C contacts of switch 46 are tied together and make connection with the setback side of G-switch 48. The second side of G-switch 48 is connected to the second side of capacitor 32. The first side of capacitor 32 is encircuited with the insulated side of crush switch 52 and trembler switch 54. The crush switch 52 is located in the nose of shell 20, and the trembler switch 54 is located in the base element fuze.

Crush switch 52 is configured to close when shell 20 impacts a target that is equivalent of penetrating as little as a 1 inch thick wood panel. Trembler switch 54 is configured to close if the shell makes a glancing impact with a target, thereby causing shell 20 to suddenly deviate from its ballistic trajectory. When either crush switch 52 or trembler switch 54 close, the detonator fuze 44 will fire when switch 46 is in armed position C. Position B of switch 46 will also complete the firing circuit, but as described later, will not bring about explosion of shell 20. If the crush switch 52 or trembler switch 54 is shorted prior to gun launch, resistor 50 will complete a connection across capacitor 32 and bring about its discharge. In the unit reduced to practice, resistor 50 had a value of 100,000 ohms. Thus the time constant of capacitor 32 and resistor 50 equals 56 ms.

The manner in which the various components accomplish the functions described above will be explained by reference to FIGS. 5–10. FIG. 5 is an enlarged side view of rotor 40. In the unit reduced to practice, the outside diameter of the rotor was about 0.75 in. The rotor is rotatably supported on land 60 by a sleeve bearing (not shown). Three pins 62, 64, and 66 are transversely mounted through the rim of the rotor (see also the cutaway cross-sectional view of FIG. 6). Latch pin 62 extends from the front face of the rotor into a horseshoe-shaped slot forming part of the supporting frame. Due to operating in a slot, latch pin 62 thus restricts rotor rotation to a 270 degree angle. First stop pin 64 extends from the rear face of the rotor and functions in combination with a drag sensor weight assembly (not shown) to position the drag weight for gun launch. Second stop pin 66 functions in combination with the above-mentioned drag sensor weight assembly to halt the rotor from turning beyond terminal B of switch 46 (See FIG. 2) unless the shell is undergoing deceleration during the ballistic trajectory phase of its flight. The components to accomplish the first and second stop functions are present in both my implementation and the prior art design. Therefore, the specific component design of the drag sensor weight assembly is not shown.

The cutaway view of the rotor is shown in FIG. 6. As shown there, the detonator elements are imbedded within the rotor. Contact 68 is part of a spring loaded piston 70 which makes electrical contact with detonator cartridge 72. As the rotor turns, contact 68 makes a wiping contact with the frame surrounding the rotor. In terms of FIG. 2, contact 68 is the center arm of switch 46, and terminals A, B, and C represent electrically conductive elements buried in the surface surrounding and immediately adjacent rotor 40.

Coiled spring 74 (see FIG. 7) supplies the motive power to turn rotor 40. The center of spring 74 fits into slot 76 formed in the end of shaft 78 which extends from rotor 40. The outermost end of coil spring 74 attaches to the frame of the base element fuze.

Notch 42 which allows cam element 38 to drop in and thereby close relay 36 is positioned as shown in FIG. 6. Located as shown in FIG. 6, notch 42 does not interfere with the proper functioning of contact 68.

FIG. 9 shows the manner in which the rotor 40 is latched in the first safety position. As shown in FIG. 9, the rotor is turned counterclockwise until latch pin 62 snaps behind catch 78. Catch 78 will retain the rotor in the first safety position due to the action of spring 80. However, when the gun is fired and the base element fuze is subjected to the rapid acceleration of the gas forces within the barrel of the gun, the fuze will accelerate as shown by arrow 26. Under these conditions, the mass M will rotate catch 78 counterclockwise until it reaches stop 82. This releases latch pin 62 from the first safety position, and spring 74 will urge it to rotate in a clockwise direction. With reference to FIG. 2, this means that switch 46 successively traverses from contacts A to B to C. When the rotor 40 reaches the C position depicted in FIG. 2, it will be in the armed condition.

FIG. 8 shows an enlarged cross-section of setback generator 28. Setback generator 28 comprises a base cup 84, a cap 86, and an inner frame 88. Inner frame 88 has wound thereon a coil 90. A magnet 92 fits slidably within inner frame 88 and rests against the base cup 84. The magnet is initially held against the base of the cup by a thin shear disc 94. At the firing of the gun, setback generator 28 is subjected to the rapid acceleration of the shell. These acceleration forces may exceed 10,000 G's. This force causes magnet 92 to shear through shear disc 94 and move rightward until it rests against the top cap 86 of the setback generator assembly. The sudden movement of the magnet causes an electric pulse to be generated within coil 90. Terminal post 96 conducts this electric pulse away from the setback generator so it can be used to charge capacitor 32 (see FIG. 2). FIG. 2 also shows the diode 30 which is encircuited between the setback generator 28 and capacitor 32. In the unit reduced to practice, diode 30 was a type IN 4004. Tests show that the setback generator of FIG. 8 is capable of charging capacitor 32 to a voltage between 120 and 200 volts.

FIG. 10 shows a cutaway view of G-switch 48 which isolates the detonator from the capacitor and the setback generator. G-switch 48 consists of a base cup 100 and top cap 102. As shown in FIG. 10, top cap 102 is crimped over base cup 100, but is assembled so as to be insulated one from the other. Within base cup 100 is a G-weight 104 which is held in the base of the cup by spring 106. During the acceleration phase of the shell down the gun barrel, G-weight 104 is held firmly against the base of the cup. Subsequent to the launch of the shell 20 out of the gun, deceleration is experienced throughout the ballistic trajectory phase of the flight. The deceleration phase causes G-weight 104 to compress spring 106 bringing the tip of the G-weight in contact with the inner surface of top cap 102. Thus during the deceleration or the ballistic trajectory phase of the flight, G-switch 48 will be closed.

Figure 3:
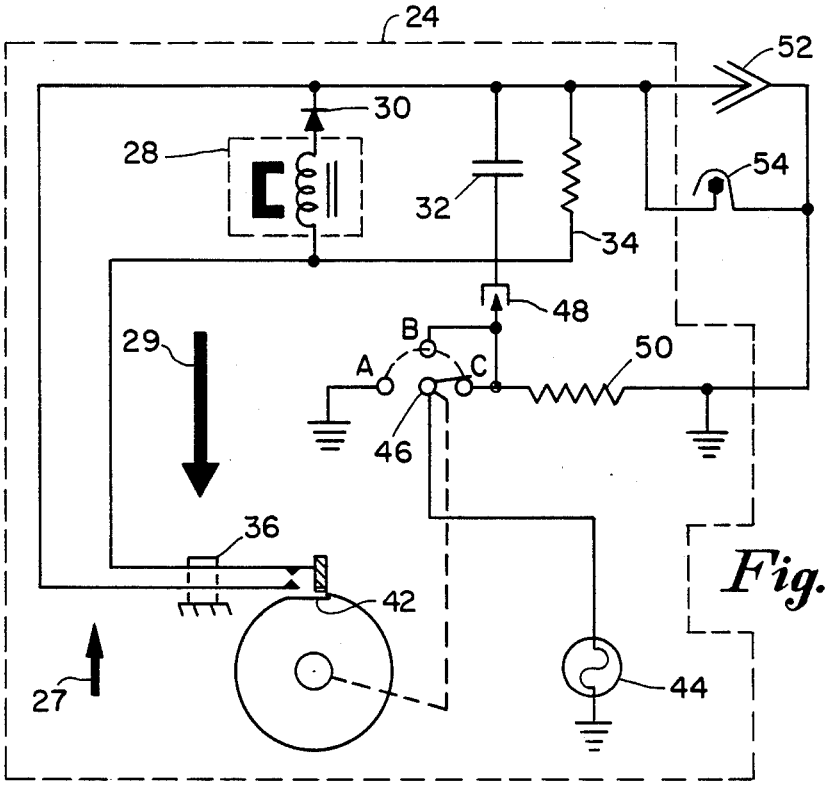
FIG. 3 is a circuit diagram of the base element fuze in the armed condition prior to launch.

Referring now to FIG. 3, there is shown a schematic of the base element fuze 24 for the case where the rotor is in the armed condition. The rotor can reach the armed condition in at least two ways. First, there is the situation where the rotor was initially in the first safety position shown in FIG. 2 and the shell underwent the firing sequence. Rapid acceleration of the shell in the gun barrel causes release of the rotor from the first safety position, and capacitor 32 is charged by setback generator 28. Rotor 40 will turn clockwise so that switch 46 progressively switches from A to B to C. The base element fuze will then be properly armed and awaiting the closing of crush switch 52 or trembler switch 54. With the rotor in the armed position shown in FIG. 3, the deceleration drag force 27 is present during ballistic flight of the shell and cam 38 will be kept from closing relay contacts 36. With relay contacts 36 held open by the drag forces on cam 38, there will be no discharge of capacitor 32. The result will be that detonator 44 will be activated by the charge on the capacitor 32 whenever the crush switch 52 or trembler switch 54 closes.

Secondly, the rotor 40 may be in the armed position shown in FIG. 3 if the rotor becomes unlatched from the first safety position before the shell is ever loaded into the gun. For this condition, the high acceleration force represented by arrow 29 which occurs at the firing of the gun, will cause cam 38 to drop into notch 42. The closing of relay contacts 36 will prevent the setback generator 28 from charging capacitor 32. Additionally, any charging spike coming from setback generator 28 will not be able to initiate detonator 44 due to the presence of G-switch 48. G-switch 48 remains in the open condition during the entire period that the shell is being accelerated down the gun barrel. Thus my invention prevents the explosion of shell 20 within the barrel of the gun. The use of G-switch 48 provides an additional safety feature in that there is a time delay before contacts within the G-switch close. Analysis shows that it takes about 4.5 ms. for G-weight 104 to make contact with top cap 102 (see FIG. 10). This time interval assures that the shell is well away from the end of the gun barrel before detonation can occur.

Figure 4:
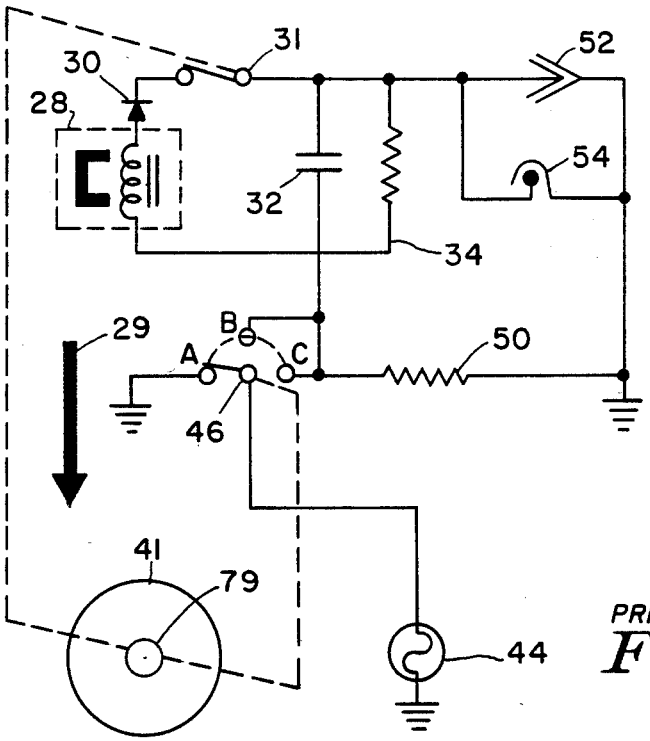
PRIOR ART Fig. 4.
FIG. 4 is a circuit diagram of the prior art base element fuze in first safety prior to launch.

FIG. 4 shows a circuit diagram of the prior art fuze. It will be noted that rotor 41 controls both the rotation of switch 46 and the opening and closing of S-2 switch 31. In the prior art base element fuze, S-2 switch 31 must be closed in order that setback generator 28 can charge capacitor 32. S-2 switch 31 is operated by a cam attached to shaft 79 which extends from rotor 41. FIG. 12 shows an enlarged view of S-2 switch 31. A palladium wire 110 is molded into an insulating medium 114. When rotor 41 is in the first safety position, wire 110 will be swung so that it makes contact with post 112. With wire 110 pressed against post 112, S-2 switch 31 will be in the closed position. Conversely, when the rotor 41 is in the armed position, wire 110 will be moved away from post 112 assuming the 110' position shown in FIG. 12. This means that for the condition where the rotor 41 becomes unlatched and moves to the armed position prior to the firing of the shell, S-2 switch 31 will be open, and the setback generator 28 is not able to charge capacitor 32. Since capacitor 32 does not receive a charge, there is no way for the detonator 44 to fire. One of the problems with the prior art base element fuze is the functioning of S-2 switch 31. If there is any dust, corrosion, or gun vibration present on either wire 110 or post 112 (see FIG. 12), a poor conductive joint will result. Thus if the closure results in a highly resistive juncture between wire 110 and post 112, the capacitor 32 will not receive a full charge. When only partially charged, capacitor 32 may or may not be able to fire detonator 44 when the shell impacts the target.

Regarding the function of the second stop pin 66 mentioned earlier with regard to FIG. 5, reference is made to FIG. 11. The rotor 40 is shown in FIG. 11 as being in the armed condition. Detonator 72 will fire when the shell intercepts the target. Firing of detonator 72 will set off squib 73 which is positioned in the top center of the base element fuze case 75. Firing of squib 73 in turn initiates the explosion of shell 20. However, if second stop pin 66 halts the rotor from turning beyond terminal B of switch 46 (see FIG. 2), rotor 40 will be halted 90 degrees before reaching the armed condition. Detonator 72 can still fire on target impact, but its flash will not be directed at squib 73, but will be fired at right angles thereto thus causing the shell to be a dud.

My invention also protects against piezoelectric effects in a barium titinate dielectric capacitor. When the gun is fired and the shell undergoes high acceleration forces of 10,000 G's, the capacitor experiences a piezoelectric polarization which may result in a dangerous voltage spike. Introduction of G-switch 48 between the capacitor and the detonator prevents accidental explosion of the shell when the rotor has somehow gotten to the armed condition prior to the time of loading the shell in the gun.

It is to be understood that FIG. 9 is only a functional representation of the way in which the rotor is unlatched from its first safety position. The actual mechanism reduced to practice is more complicated, but functionally performs as shown.

In summary, my invention provides dual safety features which prevent the shell from exploding either in the barrel of the gun or within lethal range of the gun crew after it leaves the gun barrel. I accomplish this by providing a relay which harmlessly shorts out the pulse from the setback generator whenever the rotor of the base element fuze has come unlatched and turned to the armed condition prior to loading of the shell in the gun. Second, I provide a G-switch which isolates the detonator from the capacitor until a specified time has elapsed after exit of the shell from the gun barrel. This feature protects the gun crew against both piezoelectric problems in the capacitor and accidental shorts in either the crush or trembler switches.

It should be understood that various modifications of the embodiments disclosed in this detailed description are possible. The foregoing description is provided to enable one skilled in the art to make and use the invention and should not be construed as in any way limiting.

Rather, it is intended that the scope of the invention be defined by the following claims.

I claim:

1. A dual safing and arming mechanism for a fuze to be used with a projectile shell adapted to be propelled into ballistic flight from the barrel of a gun, said mechanism comprising:

a case for housing the fuze mechanism in the base of the shell, said case enclosing frame members to which said fuze mechanisms are secured;

a detonator;

a rotor rotatably secured to said frame members and pivotable between first safety and armed positions, said rotor having said detonator seated therein, said rotor body forming a ground terminal for one side of said detonator, the second side of said detonator being encircuited with the center arm of a rotary switch which rotates in synchronism with said rotor as said rotor moves from first safety to the armed position;

latching means for holding said rotor in first safety condition until the occurrence of the shell firing event, the acceleration of said shell in the barrel of said gun causing release of said rotor for rotation to the armed position under the inducement of spring driving means;

a setback generator for generating a pulse of electricity during the shell firing event;

a capacitor encircuited to receive the electrical charge generated by said setback generator;

a G-switch encircuited between one side of said capacitor and the terminal of the rotary switch reached when said rotor is in the armed condition, the orientation of the G-swtich being such that it is electrically open when said shell accelerates down the gun barrel and is closed when the shell undergoes drag along its ballistic flight path;

impact operable switch means for encircuiting the second side of said capacitor in series with the grounded side of said detonator to fire same and initiate shell explosion at target impact; and a normally open relay encircuited across said capacitor and inertially movable to the closed state to prevent the charging of said capacitor if said rotor inadvertently rests in the armed position at the firing of the gun.

2. The invention as defined in claim 1 wherein the G-switch has a time delay of about 4.5 ms. when moving to the closed state after said shell leaves the gun barrel.

3. The invention as defined in claim 1 wherein said normally open relay includes a cam at the end of its movable contact arm, said cam being positioned adjacent the periphery of said rotor, said rotor having a notch therein at a location opposite said cam when said rotor is in the armed position, thereby allowing said cam to drop into said notch and close said relay when said shell experiences high-G acceleration forces at firing of the gun.

4. The invention as defined in claim 1 and including resistive elements which render the fuze inert if the shell does not explode on target impact.

5. The invention as defined in claim 1 wherein the setback generator is capable of charging said capacitor to a value of at least 120 volts.

6. The invention as defined in claim 5 wherein the capacitor is sized at 0.56 microfarads.

7. A dual safing and arming mechanism for a fuze having an electrically activated detonator and a rotary disarm/arm switch for coupling the detonator to an electrical detonator circuit, the improvement comprising:

means coupled to said rotary switch for disarming the electrical detonator circuit in the event the rotary switch is armed prematurely; and a normally open inertially activated switch means in series with the detonator, said switch means for connecting the detonator to the detonator circuit when the projectile experiences a deceleration after being fired.

8. A dual safing and arming mechanism as defined in claim 7 wherein said means for disarming the detonator circuit includes a rotor which rotates the rotary switch, said rotor includes a cam follower joined to relay contacts, which relay contacts disarm the electrical detonator circuit when closed by the cam follower.

* * * * *